US007086571B2

(12) United States Patent
Warby et al.

(10) Patent No.: US 7,086,571 B2
(45) Date of Patent: Aug. 8, 2006

(54) VALVES FOR PRESSURIZED DISPENSING CONTAINERS

(75) Inventors: Richard John Warby, Wisbech (GB); David Howlett, King's Lynn (GB)

(73) Assignee: Bespak PLC, Norfolk (GB)

( * ) Notice: Subject to any disclaimer, the term of this patent is extended or adjusted under 35 U.S.C. 154(b) by 295 days.

(21) Appl. No.: 10/312,198

(22) PCT Filed: Apr. 17, 2002

(86) PCT No.: PCT/GB02/01773

§ 371 (c)(1),
(2), (4) Date: May 23, 2003

(87) PCT Pub. No.: WO02/087997

PCT Pub. Date: Nov. 7, 2002

(65) Prior Publication Data

US 2003/0178448 A1 Sep. 25, 2003

(30) Foreign Application Priority Data

Apr. 30, 2001 (GB) ..... 0110545

(51) Int. Cl.
*B65D 83/00* (2006.01)

(52) U.S. Cl. ..... 222/402.1; 222/402.2; 222/402.24; 222/453

(58) Field of Classification Search ..... 222/402.1, 222/402.2, 402.22, 402.23, 402.24, 402.25, 222/402.16, 453, 402.19
See application file for complete search history.

(56) References Cited

U.S. PATENT DOCUMENTS 2,307,986 A 1/1943 Bolte et al.
2,672,144 A 3/1954 Cohen
3,169,677 A * 2/1965 Focht ..... 222/402.2
3,272,442 A 9/1966 Rink et al.
4,017,007 A 4/1977 Riccio
4,034,899 A 7/1977 Meshberg
4,252,848 A 2/1981 Datta et al.
4,417,890 A 11/1983 Dennehey et al.
4,427,137 A * 1/1984 Dubini ..... 222/402.2
4,645,487 A 2/1987 Shishov et al.
4,842,168 A * 6/1989 Bougamont et al. ..... 222/402.2
4,844,986 A 7/1989 Karakelle et al.
4,857,080 A 8/1989 Baker et al.
4,875,605 A 10/1989 Weston
4,948,628 A 8/1990 Montgomery et al.
5,027,985 A * 7/1991 Abplanalp ..... 222/402.1
5,169,038 A * 12/1992 Di Giovanni ..... 222/402.2
5,341,800 A 8/1994 Clark et al.
5,349,944 A 9/1994 Chippendale et al.
5,474,758 A 12/1995 Kwon
5,490,497 A 2/1996 Chippendale et al.
5,576,068 A 11/1996 Caburet et al.
5,632,421 A * 5/1997 Colombo ..... 222/402.2

(Continued)

FOREIGN PATENT DOCUMENTS

DE 197 00 838 A1 7/1998

(Continued)

*Primary Examiner*—Frederick C. Nicolas
(74) *Attorney, Agent, or Firm*—Bacon & Thomas, PLLC

(57) ABSTRACT

A valve for use with a pressurized dispensing container containing a liquid, the valve including a slidable valve stem, the valve stem including an inlet port for conveyance, in use, of liquid from the pressurized dispensing container into the valve stem, and a flange against which biases the valve stem into a non-dispensing position, wherein an external opening of the inlet port is located within the flange.

7 Claims, 5 Drawing Sheets

U.S. PATENT DOCUMENTS

| | | | | |
|---|---|---|---|---|
| 5,683,361 | A | 11/1997 | Elk et al. | |
| 5,775,321 | A | 7/1998 | Alband | |
| 5,836,299 | A | 11/1998 | Kwon | |
| 5,857,456 | A | 1/1999 | Sun et al. | |
| 5,871,010 | A | 2/1999 | Datta et al. | |
| 5,884,820 | A | 3/1999 | Thanisch et al. | |
| 5,904,274 | A | 5/1999 | Warby et al. | |
| 5,921,447 | A * | 7/1999 | Barger et al. | 222/402.2 |
| 6,006,745 | A | 12/1999 | Marecki | |
| 6,039,042 | A | 3/2000 | Sladek | |
| 6,120,481 | A | 9/2000 | Rennert et al. | |
| 6,131,566 | A | 10/2000 | Ashurst et al. | |
| 6,253,762 | B1 | 7/2001 | Britto | |
| 6,358,569 | B1 | 3/2002 | Badyal et al. | |
| 6,640,805 | B1 * | 11/2003 | Castro et al. | 128/200.23 |

FOREIGN PATENT DOCUMENTS

| | | | |
|---|---|---|---|
| DE | 199 42 791 | A | 3/2001 |
| EP | 0 360 463 | | 3/1990 |
| EP | 0 407 276 | A | 1/1991 |
| EP | 0407276 | A | 1/1991 |
| EP | 0469926 | | 2/1992 |
| EP | 0 808 635 | A2 | 11/1997 |
| EP | 0 906 765 | A1 | 4/1999 |
| FR | 2 775 963 | A | 9/1999 |
| GB | 1 338 254 | | 11/1973 |
| GB | 2087355 | A | 5/1982 |
| GB | 2 367 756 | A | 4/2002 |
| WO | WO 9102558 | | 3/1991 |
| WO | WO 9106333 | | 5/1991 |
| WO | WO 92/06727 | | 4/1992 |
| WO | WO 93/11818 | A | 6/1993 |
| WO | WO 96 28367 | A | 9/1996 |
| WO | WO 9632345 | | 10/1996 |
| WO | WO 97 32672 | | 9/1997 |
| WO | WO 97 47347 | | 12/1997 |
| WO | WO 98/51360 | | 11/1998 |
| WO | WO 98/55168 | | 12/1998 |
| WO | WO 99/42154 | | 8/1999 |
| WO | WO 99 42154 | | 9/1999 |
| WO | WO 99/46055 | | 9/1999 |
| WO | WO 99 49923 | A | 10/1999 |
| WO | WO 00/16835 | | 3/2000 |
| WO | WO 2001/010742 | A1 | 2/2001 |
| WO | WO 01 43529 | A | 6/2001 |
| WO | WO 02 305500 | A | 4/2002 |

* cited by examiner (PRIOR ART)

FIG. 5.

First Embodiment

| | | Pack 1 | Pack 2 | Pack 3 | Pack 4 | Pack 5 | | | |
|---|---|---|---|---|---|---|---|---|---|
| Start | LOP 1 | 100.2 | 100.5 | 100.2 | 100.1 | 101.0 | | | |
| | LOP 2 | 99.1 | 100.2 | 100.5 | 99.6 | 99.0 | | | |
| Middle | LOP 1 | 97.4 | 100.5 | 96.5 | 100.9 | 98.6 | | | |
| | LOP 2 | 99.4 | 100.0 | 99.5 | 100.1 | 100.2 | | | |
| End | LOP 1 | 95.5 | 97.9 | 101.2 | 95.7 | 102.5 | StDev | Min | Max |
| | LOP 2 | 100.0 | 99.8 | 96.7 | 99.4 | 103.1 | 1.762 | 95.5 | 103.1 |

Second Embodiment

| | | Pack 1 | Pack 2 | Pack 3 | Pack 4 | Pack 5 | | | |
|---|---|---|---|---|---|---|---|---|---|
| Start | LOP 1 | 95.8 | 96.5 | 95.8 | 98.8 | 97.2 | | | |
| | LOP 2 | 95.6 | 96.6 | 97.2 | 98.5 | 97.3 | | | |
| Middle | LOP 1 | 95.0 | 99.4 | 101.4 | 94.8 | 95.6 | | | |
| | LOP 2 | 99.9 | 99.8 | 100.9 | 98.8 | 99.2 | | | |
| End | LOP 1 | 96.0 | 96.9 | 95.0 | 97.2 | 93.4 | StDev | Min | Max |
| | LOP 2 | 101.1 | 99.6 | 99.2 | 99.6 | 98.8 | 2.107 | 93.4 | 101.4 |

Conventional Valve

| | | Pack 1 | Pack 2 | Pack 3 | Pack 4 | Pack 5 | | | |
|---|---|---|---|---|---|---|---|---|---|
| Start | LOP 1 | 93.6 | 89.4 | 92.2 | 83.3 | 92.2 | | | |
| | LOP 2 | 95.9 | 98.6 | 97.7 | 98.1 | 98.0 | | | |
| Middle | LOP 1 | 90.8 | 92.4 | 91.6 | 94.0 | 96.9 | | | |
| | LOP 2 | 99.5 | 99.5 | 98.4 | 95.4 | 99.4 | | | |
| End | LOP 1 | 94.6 | 89.0 | 91.2 | 94.9 | 95.4 | StDev | Min | Max |
| | LOP 2 | 98.9 | 98.8 | 100.5 | 99.3 | 99.5 | 4.088 | 83.3 | 100.5 |

VALVES FOR PRESSURIZED DISPENSING CONTAINERS

The invention relates to improvements in valves for pressurised dispensing containers.

Pressurised dispensing containers are used for dispensing a wide variety of products from mobile to viscose liquid products, powdered products and the like and typically employ a liquid propellant such as a hydrocarbon or fluorocarbon having sufficiently high vapour pressure at normal working temperatures to propel the product through the valve. These are commonly used for dispensing pharmaceutical medicaments.

A conventional valve, in this case a metering valve for use with pressurised dispensing containers 30, is shown in FIG. 1 and comprises a valve stem 11 co-axially slidable within a valve member 12 defining an annular metering chamber 13. "Inner" 18 and "outer" annular seals 17 are operative between the valve stem and the valve member to seal the metering chamber therebetween. The valve stem is generally movable against the action of a spring 25 to a dispensing position, wherein the metering chamber is isolated from the container and vented to atmosphere via radial outlet port 21 for the discharge of product.

The valve is usually held in place with respect to the container by a closure 15 which is crimped to the container.

Dispensing containers are often used to dispense, amongst other products, powdered medicaments which are stored in the container, suspended in a liquified propellant. The powdered medicament is dispensed from the container, on actuation of the aerosol, together with the propellant as the propellant boils off. To use a dispensing apparatus comprising a metering valve as described above, a user first shakes the pressurised dispensing container and attached metering valve to agitate the liquified propellant and suspended powdered medicament. The agitation of the propellant homogenises the suspended powder medicament such that the concentration of suspended powdered medicament in the liquified propellant is substantially constant throughout the propellant volume. The pressurised dispensing container is then inverted such that the valve stem of the metering valve is lowermost and actuated by depressing the valve stem relative to the pressurised dispensing container. The liquified propellant and suspended powdered medicament contained in the annular metering chamber is vented to atmosphere via radial outlet port 21 where it is, for example, inhaled by the user. On release of the valve stem, the spring restores the valve stem to its unactuated position, whereby the annular metering chamber is re-charged with liquified propellant and suspended powdered medicament from the volume of liquified propellant stored in the pressurised dispensing container via radial inlet port 24 and radial transfer port 23.

It has been found that a problem occurs with operation of a metering valve as described above particularly where the valve is stored upright between actuations or horizontal when the container contents are part-depleted such that the valve member 12 and radial inlet port 24 are not submerged by the liquified propellant/product mixture. In these situations it has been found that 'drainback' can occur wherein liquified propellant/product in the metering chamber 13 drains out back into the body of the container 30 through radial inlet port 24. This leads to a reduction in the amount of product contained in the metering chamber 13 ready for the next actuation, leading to a low level of active product being delivered to the user.

Previously, to alleviate this problem the diameter of the radial inlet port 24 in the valve stem 11 has been kept small such that the capillary effect of the hole on the propellant/product mixture largely prevents movement of the liquid through the radial inlet port 24.

The applicant has discovered that in certain situations this capillary effect is in itself ineffective at preventing drainback in conventional metering valves. In particular, where the valve stem 11 is provided with a flange 26 in close proximity to the radial inlet port 24. In this arrangement liquid will congregate between the flange 26 and the underside 9 of the inner seat 18 adjacent to or in contact with the radial inlet port 24. The effect of this liquid at this point is to reduce the capillary effect of the radial inlet port 24 leading to increased drainback.

According to the present invention, there is provided a valve for use with a pressurised dispensing container containing a liquid, the valve comprising a slidable valve stem, the valve stem comprising an inlet port for conveyance, in use, of liquid from the pressurised dispensing container into the valve stem, and a flange against which acts a biassing means which biases the valve stem into a non-dispensing position, wherein an external opening of the inlet port is located within the flange.

There is also provided a valve for use with a pressurised dispensing container containing a liquid, the valve comprising a slidable valve stem, the valve stem comprising an inlet port for conveyance, in use, of liquid from the pressurised dispensing container into the valve stem, and a flange against which acts a biassing means which biases the valve stem into a non-dispensing position, wherein the flange comprises a cut-out portion aligned with an external opening of the inlet port.

Embodiments of the present invention will now be described by way of example only, with reference to the accompanying drawings, in which:

FIG. 5 is a table of results of comparative shot weight tests.

Figure 1:
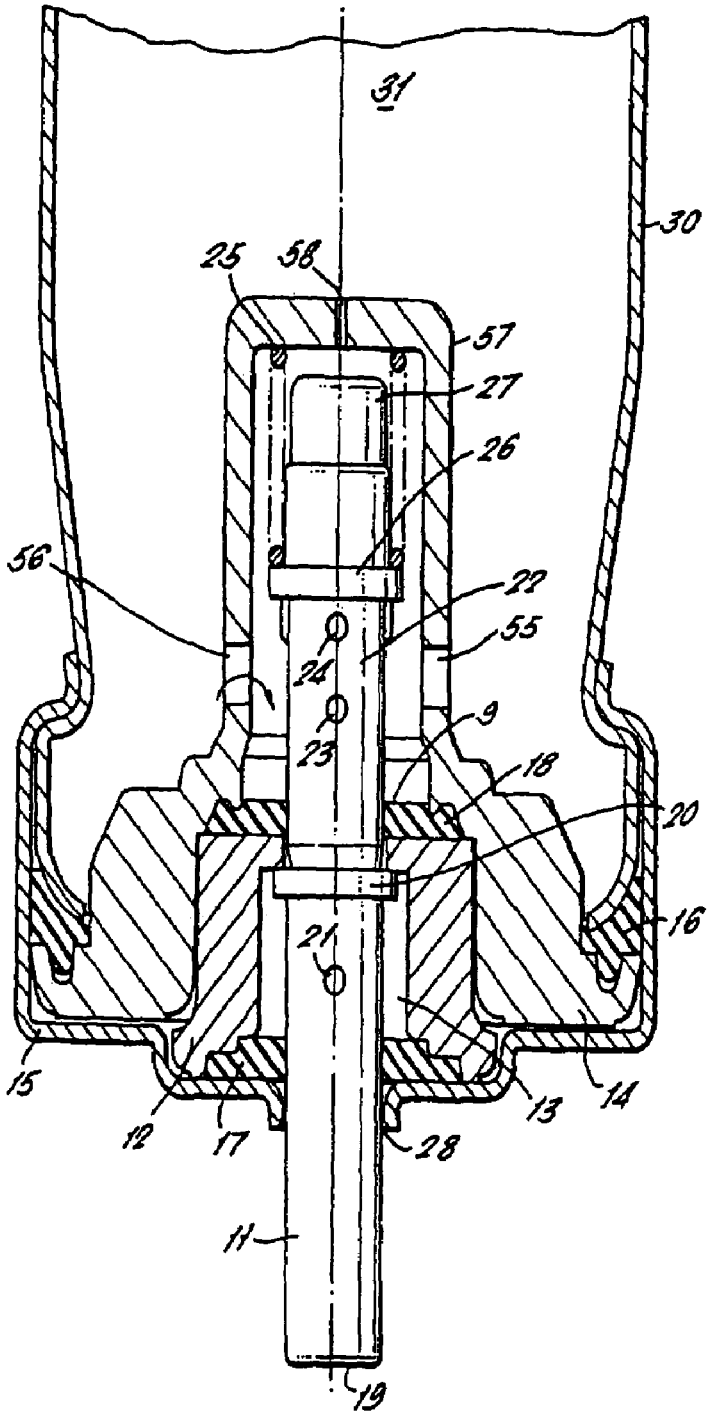
FIG. 1 is a cross-sectional view of a conventional metering valve and pressurised dispensing container.

As shown in FIG. 1, a conventional metering valve 10, includes a valve stem 11 which protrudes from and is axially slidable within a valve member 12, the valve member 12 and valve stem 11 defining therebetween an annular metering chamber 13. The valve member 12 is located within a valve body 14 which is positioned within a pressurised container 30 containing a product to be dispensed. The metering valve 10 is held in position with respect to the container 30 by means of a ferrule 15 which is crimped to the top of the container. Sealing between the valve body 14 and container 30 is provided by an annular gasket 16. The ferrule 15 has an aperture 28 through which one end 19 of the valve stem 11 protrudes.

The pair of seals 17, 18 of an elastomeric material extend radially between the valve stem 11 and the valve member 12. The "outer" seal 17 is radially compressed between the valve member 12, valve stem 11 and ferrule 15 so as to provide positive sealing contact to prevent leakage of the contents of the metering chamber 13 between the valve stem 11 and the aperture 28. The compression is achieved by using a seal which provides an interference fit on the valve stem 11 and/or by the crimping of the ferrule 15 onto the pressurised container 30 during assembly. The "inner" seal is located between valve member 12 and valve body 14 to seal an "inner" end of the metering chamber 13 from the container contents.

The end 19 of the valve stem 11 is the discharging end of the valve stem 11 and protrudes from the ferrule 15. The end 19 is a hollow tube, which is closed off by a first flange 20 which is located within the metering chamber 13. The hollow end 19 of the valve stem 11 includes a discharge port 21 extending radially through the side wall of valve stem 11. The valve stem 11 further has an intermediate section 22, extending between the first flange 20 and a second flange 26. The intermediate section 22 is also hollow between the flanges 20, 26 and defines a central passage. It also has a radial transfer port 23 and a radial inlet port 24 which are interconnected through the central passage. The second flange 26 separates the intermediate section 22 of the valve stem 11 and an inner end 27 of the valve stem 11.

A spring 25 extends between the second flange 26 and a shoulder defined by the valve body 14 to bias the valve stem 11 into a non-dispensing position in which the first flange 20 is held in sealing contact with the outer seal 17. The second flange 26 is located outside the metering chamber 13, but within the valve body 14.

The metering chamber 13 is thus sealed from the atmosphere by the outer seal 17, and from the pressurised container 30 to which the valve 10 is attached by the inner seal 18. In the non-dispensing position, radial transfer port 23 and radial inlet port 24, together with the central cavity in the intermediate section 22 of the valve member 11 connect the metering chamber 13 with the valve body 14. Inlet ports 55, 56 connect the valve body 14 with the container 30 so that in this non-dispensing condition, the metering chamber 13 will be charged with product to be dispensed. The valve body 14 is also provided with a relatively small diameter vapour vent hole 58. The metering valve 10 and pressurised dispensing container 30 together form a dispensing apparatus. In use, the dispensing apparatus is inverted such that the valve stem 11 is lowermost, as shown in FIG. 1, such that the liquified propellant 31 in the pressurised dispensing container 30 collects at the end of the pressurised dispensing container 30 adjacent the metering valve 10 so as to cover inlet ports 55, 56. Upon depression of the valve stem 11 relative to the valve member 12 so that it moves inwardly into the container 30, the radial inlet port 24 is closed off as it passes through the inner seal 18 thereby isolating the metering chamber 13 from the contents of the valve body 14 and pressurised dispensing container 30. Upon further movement of the valve stem 11 in the same direction to a dispensing position, the discharge port 21 passes through the outer seal 17 into communication with the metering chamber 13. In this dispensing position which is shown in FIG. 1, the product in the metering chamber 13 is free to be discharged to the atmosphere via the discharge port 21 and the cavity in the hollow end 19 of the valve stem 11.

When the valve stem 11 is released, the biassing of the return spring 25 causes the valve stem 11 to return to its original position. Vapour vent hole 58 accommodates escape of any air trapped within valve body 14. As a result, product in the pressurised dispensing container 30 passes through inlet ports 55, 56 into valve body 14 and in turn from valve body 14 into the metering chamber 13 via the radial transfer port 23 and inlet port 24 to re-charge the chamber 13 in readiness for further dispensing operations. Due to its relatively small diameter, little product enters the valve body 14 through vapour vent hole 58.

Figure 2:
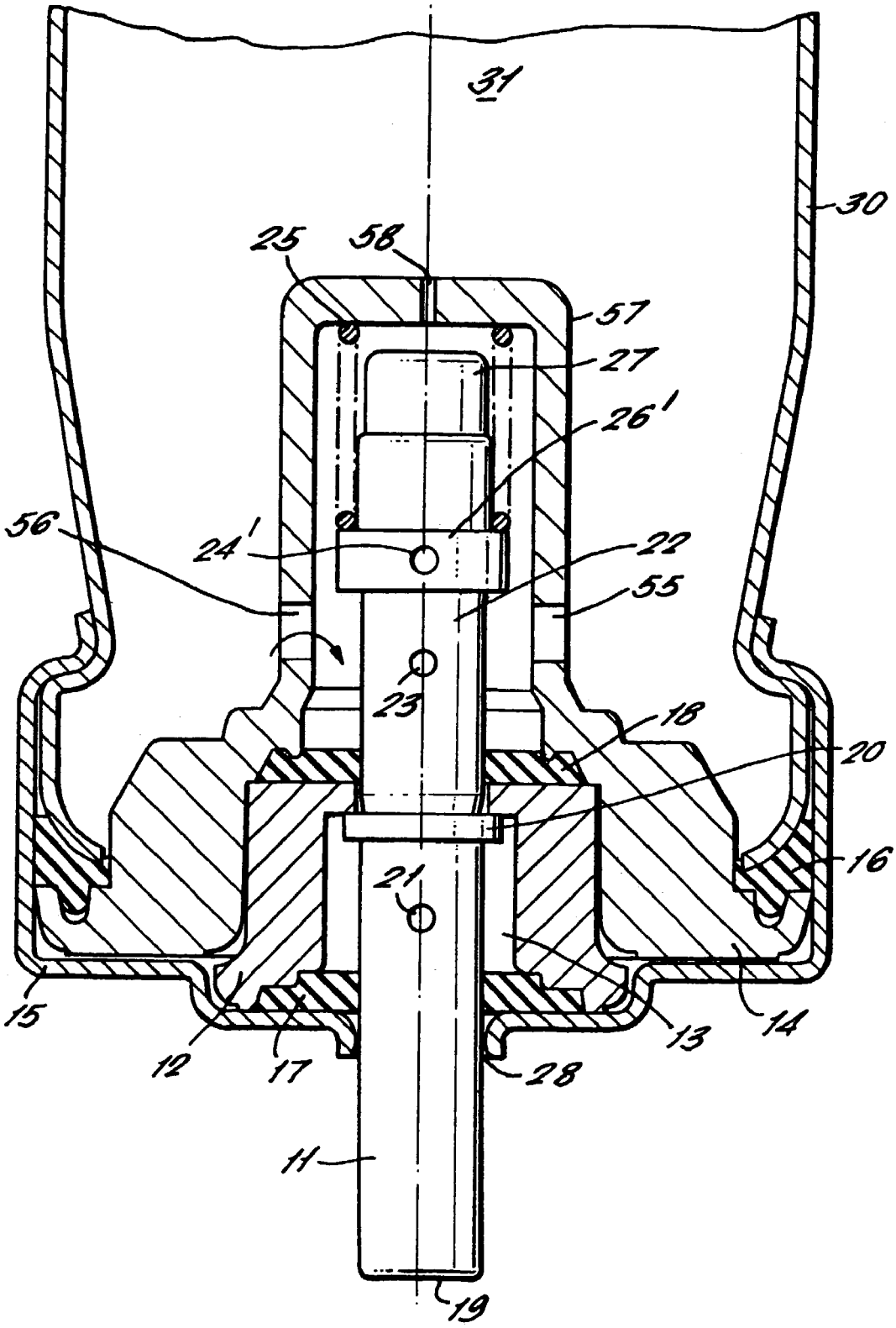
FIG. 2 is a cross-sectional view of a first embodiment of metering valve according to the present invention.

FIG. 2 shows a first embodiment of dispensing apparatus according to the present invention. Like components to the apparatus of FIG. 1 have been referenced by like numerals. Only the features which differ will now be described in further detail. According to the present invention the second flange 26' has been widened and the external opening of the radial inlet port 24' positioned within the flange 26' rather than adjacent thereto. The radial inlet port 24' has a diameter of between 0.25 to 0.70 mm and an axial length of approximately 1.55 mm. This arrangement has two advantages. Firstly, there is no ledge or similar construction beneath the radial inlet port 24' against which liquid may accumulate. Secondly, the path length of the radial port 24' has been lengthened compared to an inlet port positioned within the wall of the valve stem 11, which improves the capillary effect.

Figure 3:
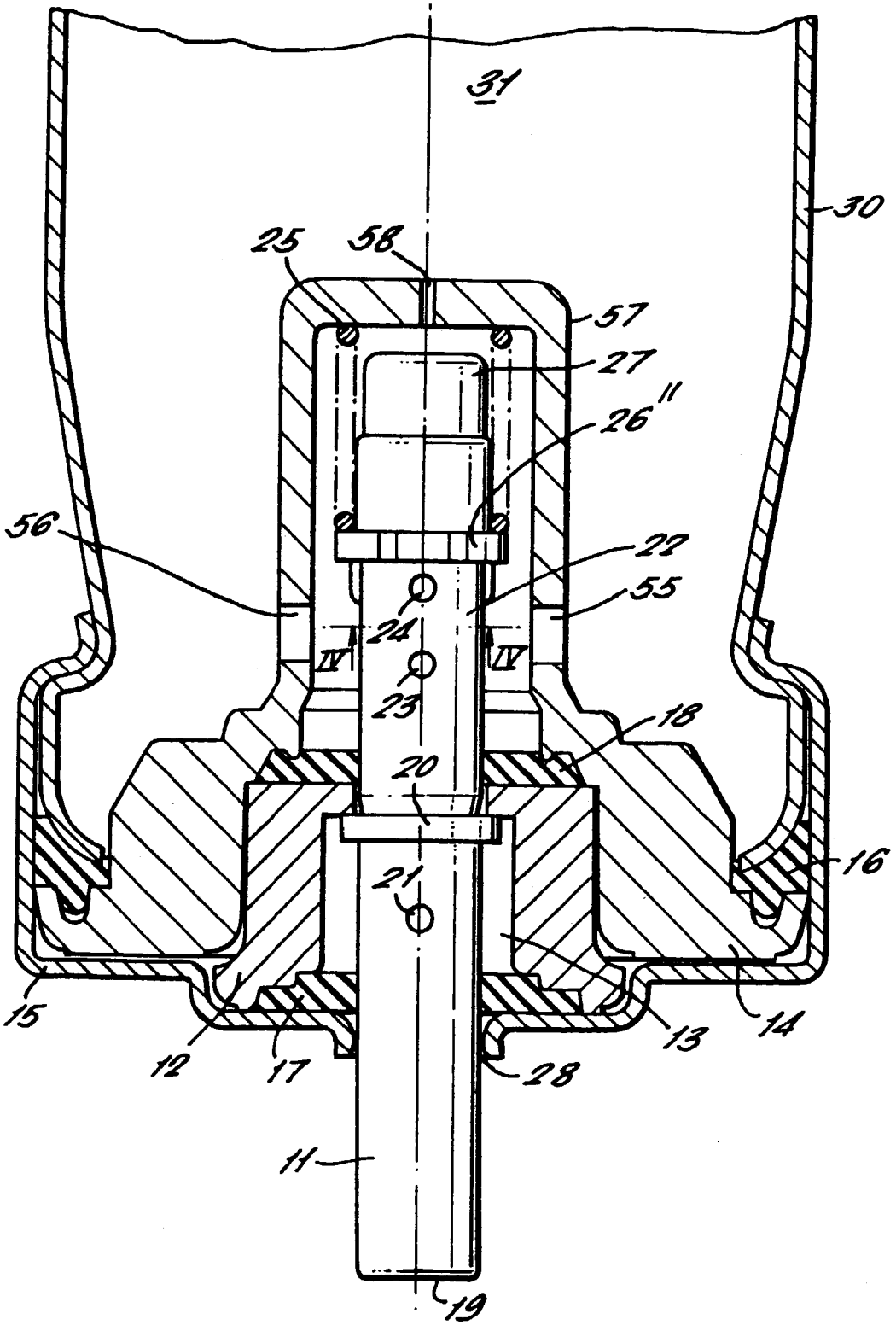
FIG. 3 is a cross-sectional view of a second embodiment of metering valve according to the present invention.
Figure 4:
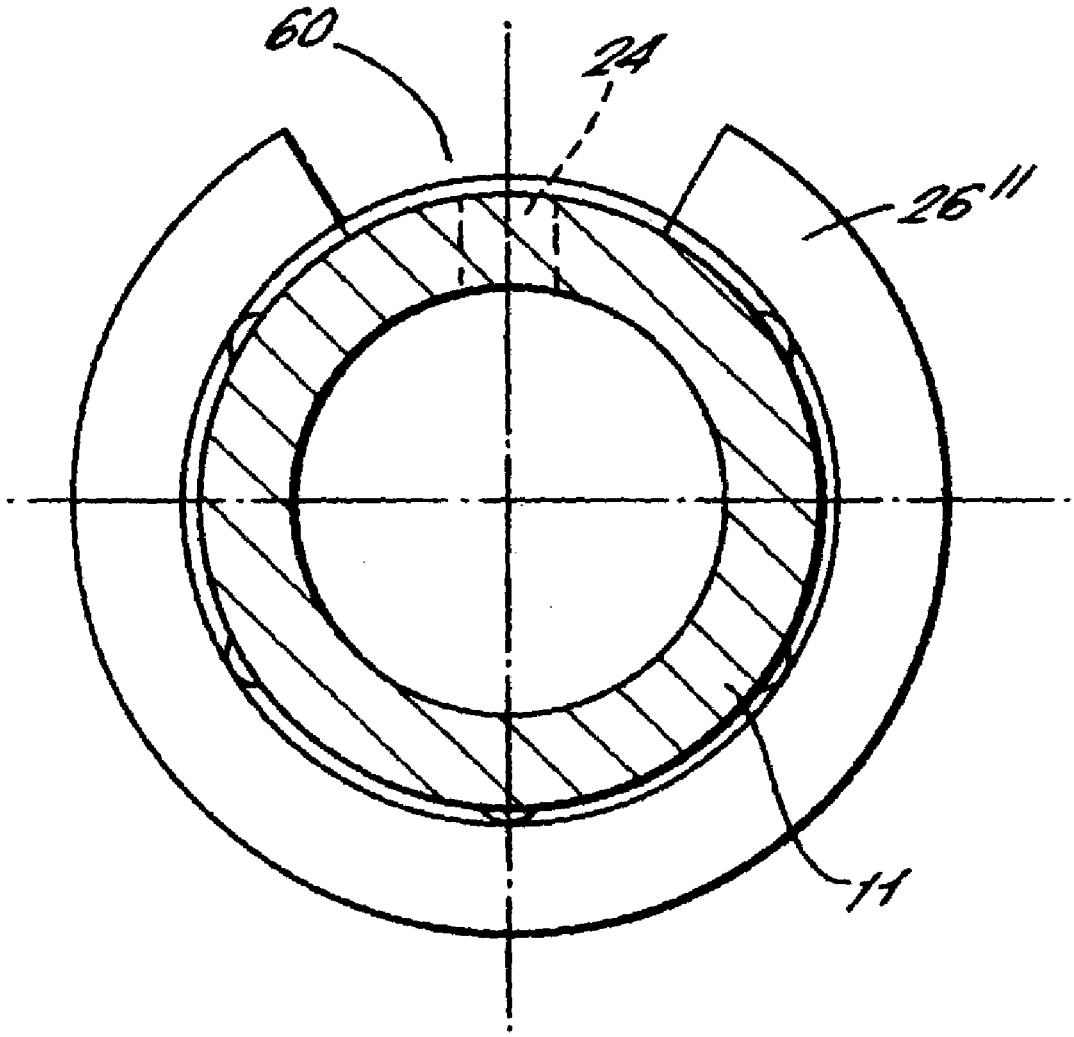
FIG. 4 is a cross-sectional view taken along line IV—IV of FIG. 3.

FIGS. 3 and 4 show a second embodiment of dispensing apparatus according to the present invention. Like components to the apparatus of FIG. 1 have been referenced by like numerals. Only the features which differ will now be described in further detail. According to the present invention the second flange 26" comprises a cut-out segment 60 in-line with the radial inlet port 24. The radial inlet port 24 has a diameter of between 0.25 to 0.70 mm and an axial length of approximately 0.95 mm. As most clearly shown in FIG. 4 the cut-out segment 60 results in there being no ledge or similar construction beneath the radial inlet port 24 against which liquid can accumulate.

Consequently, in both the first and second embodiments, liquid is prevented from accumulating against or adjacent to the radial port 24, 24'. As a result the capillary effect of the radial port 24, 24' is improved.

The first and second embodiments of valve were tested against a conventional valve to compare the degree of drainback. FIG. 5 shows the results. For each of the conventional valve and first and second embodiments, five valves (packs) were tested at the beginning, middle and end of their service life (200 actuations). At each test point two actuations were recorded (L.O.P.1 and L.O.P.2). The 'loss of prime' was measured and standardised against the nominal shot weight of the valve (where 100 represents nominal shot weight). Loss of prime is another way of stating the degree of loss from the metering chamber 13 between actuations. For this test all valves were 63 microlitres in volume and all components were identical except for the valve stems 11. As a result any difference in loss of prime between the conventional valves and the first and second embodiments may be attributed to differences in the degree of drainback.

As can be seen from FIG. 5, for the conventional valve the minimum shot weight recorded was 83.3 compared to 95.5 for the first embodiment and 93.4 for the second embodiment. In practice, a shot weight below 90 would be sufficient for a valve to be rejected. For the conventional valve three readings were below this level which in practice would have resulted in the rejection of two of the five valves (packs 2 and 4). None of the valves of the first or second embodiments had a shot weight below 90.

Further, the variation between shot weights was significantly less in the first embodiment (standard deviation=1.762) and the second embodiment (standard deviation=2.107) compared to the conventional valve (standard deviation=4.088). Improved consistency in shot weight is highly desirable where the product is a medicinal product.

The invention claimed is:

1. A metering valve for use with a pressurized dispensing container containing a liquid, the valve comprising a slidable valve stem slidable within a metering chamber, the valve stem comprising an inlet port located outside the metering chamber and for conveyance, in use, of the liquid from the pressurized dispensing container into the valve stem, and a flange against which acts a biasing means which biases the valve stem into a non-dispensing position, wherein the inlet port has a path length and an external opening of the inlet port is located within the flange; and wherein the valve stem further comprises a transfer port having a path length for conveyance, in use, of the liquid from within the valve stem into the metering chamber when the valve stem is in the non-dispensing position, wherein the path length of the inlet port is substantially greater than the path length of the transfer port.

2. A valve as claimed in claim 1 wherein the path length of the inlet port is approximately twice the path length of the transfer port.

3. A valve as claimed in claim 1 wherein the inlet port has a diameter of 0.20 to 0.70 mm.

4. A valve as claimed in claim 1 wherein the path length of the inlet port is approximately 1.55 mm.

5. A valve as claimed in claim 2 wherein the inlet port has a diameter of 0.20 to 0.70 mm.

6. A valve as claimed in claim 2 wherein the path length of the inlet port is approximately 1.55 mm.

7. A valve as claimed in claim 3 wherein the path length of the inlet port is approximately 1.55 mm.

* * * * *